US009235223B2

(12) United States Patent
Carlucci et al.

(10) Patent No.: US 9,235,223 B2
(45) Date of Patent: Jan. 12, 2016

(54) MODULAR TRAVEL POWER ADAPTER AND CONVERTER SYSTEM

(71) Applicant: Conair Corporation, Stamford, CT (US)

(72) Inventors: Vito Carlucci, Stratford, CT (US); Sergio Lopes Fernandes da Costa, Danbury, CT (US)

(73) Assignee: Conair Corporation, Stamford, CT (US)

( * ) Notice: Subject to any disclaimer, the term of this patent is extended or adjusted under 35 U.S.C. 154(b) by 233 days.

(21) Appl. No.: 13/687,365

(22) Filed: Nov. 28, 2012

(65) Prior Publication Data

US 2014/0145689 A1 May 29, 2014

(51) Int. Cl.

| | |
|---|---|
| ***H01R 27/00*** | (2006.01) |
| ***G05F 1/45*** | (2006.01) |
| ***H01R 31/06*** | (2006.01) |
| *H01R 103/00* | (2006.01) |

(52) U.S. Cl.

CPC *G05F 1/45* (2013.01); *H01R 31/06* (2013.01); *H01R 31/065* (2013.01); *H01R 2103/00* (2013.01)

(58) Field of Classification Search

CPC ..... G05F 1/45; H01R 31/065; H01R 31/06; H01R 2103/00

USPC ..... 439/218, 222, 638, 650, 956

See application file for complete search history.

(56) References Cited

U.S. PATENT DOCUMENTS

| | | | |
|---|---|---|---|
| D292,281 | S | 10/1987 | Poliak et al. |
| D292,397 | S | 10/1987 | Poliak et al. |
| D329,423 | S | 9/1992 | Luu |
| D375,080 | S | 10/1996 | Sandor et al. |
| D375,081 | S | 10/1996 | Sandor et al. |
| 5,613,863 | A | 3/1997 | Klaus et al. |

(Continued)

FOREIGN PATENT DOCUMENTS

| | | | |
|---|---|---|---|
| GB | 1333538 | A | 10/1973 |

OTHER PUBLICATIONS

Crislip, K. 'Flashpacker Guide to Packing a Laptop Backpack With Travel Gadgets.' About Dot Com Student Travel; 2006;[retrieved on Mar. 26, 2014] <URL: http://studenttravel.about.com/od/luggagetravelbackpacks/ss/gift_bpack_tech_6.htm>. Entire Document.

(Continued)

*Primary Examiner* — Khiem Nguyen

(74) *Attorney, Agent, or Firm* — Carter, DeLuca, Farrell & Schmidt, LLP

(57) ABSTRACT

An adapter-converter assembly for use with an electrical outlet is disclosed including a main body having a first, second and third universal female outlets defining first, second and third outlet configurations, and a first male plug defining a first plug configuration. A second body has a fourth universal female outlet defining the second outlet configuration and a second male plug defining a second plug configuration. The second male plug is receivable in at least one of the female outlets and the fourth female outlet is configured to receive the first male plug. A third body has a fifth universal female outlet defining the third outlet configuration and a third male plug defining a third plug configuration. The third male plug receivable in at least one of the first, second and third female outlets and the fifth female outlet is configured to receive the first male plug.

16 Claims, 11 Drawing Sheets

(56) References Cited

U.S. PATENT DOCUMENTS

| | | | |
|---|---|---|---|
| D462,056 | S | 8/2002 | Chung |
| D540,257 | S | 4/2007 | Ivanova et al. |
| D549,650 | S | 8/2007 | Russell et al. |
| D552,036 | S | 10/2007 | Holland |
| D559,783 | S | 1/2008 | Matzdorff et al. |
| 7,371,122 | B2 | 5/2008 | Ivanova |
| D576,552 | S | 9/2008 | Caine et al. |
| D617,277 | S | 6/2010 | Fahrendorff et al. |
| D623,595 | S | 9/2010 | Ruffner |
| D633,868 | S | 3/2011 | Cullen et al. |
| D657,314 | S | 4/2012 | Ruffner |
| D669,433 | S | 10/2012 | Lee |

OTHER PUBLICATIONS

Travelon Universal 3 in 1 Adapter, Converter, and USB Charger. Youtube [online]. Nov. 12, 2010; [retrieved on Mar. 26, 2014] URL:http://www.youtube.com/watch?v=wensvL_Fxw0. Entire Document.

International Search Report for PCT/US13/72170, dated Apr. 22, 2014, 2 pages.

MODULAR TRAVEL POWER ADAPTER AND CONVERTER SYSTEM

BACKGROUND

1. Technical Field

The present invention relates to electrical appliance accessories and, more particularly, to portable power adapters and adapter-converter devices.

2. Background of Related Art

Most single-phase, alternating-current electrical power outlets around the world supply power at either 210-240 volts at 50 Hz or 100-120 volts at 60 Hz. Typically the supplied voltage level is based on the existing infrastructure found in a specific geographical region, e.g. the United Kingdom (U.K.), Unites States (U.S.), Northern and Southern Europe (Europe), India, Italy, Switzerland, Japan, Australia, etc. If an appliance or device is designed for use with a particular voltage range, for example, 210 to 240 volts or 100 to 120 volts, but the available power outlet provides voltage at a different range, a converter is necessary to convert the voltage supplied by the power outlet into the voltage required by the appliance or device before the appliance or device can be used.

Various geographical regions also use different standards for the physical configuration of the interface to the electrical power outlet. Thus, an adaptor is needed to accommodate a power outlet having a physical interface that has a different standard than the plug associated with a specific appliance or device.

Various known power adapters and converters exist for adapting an electrical power outlet or socket, such as a wall plug, having a first standard and/or voltage range for use with a particular electrically powered appliance or device having a second standard and/or voltage range. Such adapters and adapter-converter devices may consist of a single, unitary body having one or more sets of openings to receive the plug of one or more appliances, and having at least one set of male contacts for being received within the wall plug. Others may comprise one or more modular bodies that may be connected together or separated for various uses. Certain drawbacks exist with many available models including, but not limited to, bulky size, inconvenient operation, and lack of durability.

SUMMARY

The present invention provides a portable power adapter-converter that is capable of multiple physical and electrical configurations to accommodate connection to physical interfaces having different standards and voltage ranges. The presently provided portable power adapter-converter is superior to known designs in terms of ease of use, versatility, storage and transport, durability and other characteristics.

Disclosed is a three-piece, modular adapter-converter assembly having components that may be used in various combinations. The components may have multiple physical interfaces and may include electrical conversion functions.

The assembly includes a main body, a first adapter, and a second adapter each having multiple male and female interfaces. Each interface may be configured to plug into multiple types of external outlets. Each adapter may be configured to plug into the other respective components of the assembly. The main body may have a moveable portion that folds into and out of the main body to present or to withdraw male interface prongs.

More particularly, the adapter-converter assembly includes a main body having a top, a bottom, a first side and a second side. The main body includes a first universal female outlet defining a first outlet configuration disposed on the top of the main body, a second universal female outlet defining a second outlet configuration disposed on the first side of the main body, and a third universal female outlet defining a third outlet configuration disposed on the second side of the main body. The bottom of the main body includes a first male plug defining a first plug configuration disposed thereon. The first male plug is electrically connected to the first, second, and third female outlets such that power received by the first male plug is transmitted to the first, second, and third female outlets. The adapter-converter assembly further includes a second body having a fourth universal female outlet defining the second outlet configuration disposed on a first side and a second male plug defining a second plug configuration disposed on a second side. The second male plug is configured and dimensioned for reception in at least one of the first and second female outlets and the fourth female outlet is configured and dimensioned to receive the first male plug. The adapter-converter assembly further includes a third body having a fifth universal female outlet defining the third outlet configuration disposed on a first side and a third male plug defining a third plug configuration disposed on a second side. The third male plug is configured and dimensioned for reception in at least one of the first, second and third female outlets and the fifth female outlet is configured and dimensioned to receive the first male plug. The first and second outlet configurations may be substantially the same.

In a first configuration, the second male plug of the second body may be inserted into the second female outlet of the main body and the third male plug of the third body may be inserted into the third female outlet of the main body. In a second configuration, the first male plug of the main body may be inserted into the fourth female outlet of the second body. When in the second configuration, the third male plug of the third body may be inserted into the third female outlet of the main body. In a third configuration, the first male plug of the main body may be inserted into the fifth female outlet of the third body. When in the third configuration, the second male plug of the second body may be inserted into the second female outlet of the main body.

The bottom may include a recess and the first male plug may be rotatably disposed within the recess. The first male plug may include a first prong and a second prong. The first and second prongs may be rotatable relative to one another between a first orientation, where the first and second prongs are substantially parallel, and a second orientation, where the first and second prongs are at an angle to one another.

The main body may include a universal serial bus port disposed in electrical communication with the first male plug. The main body may further include a surge protection circuit. The main body may include a high power TRIAC power converter circuit. The high power TRIAC power converter circuit may be electrically associated with the first female outlet of the main body.

In the alternative, an adapter-converter assembly for use with an electrical outlet includes a main body having at least one universal female outlet defining a first outlet configuration and a first male plug defining a first plug configuration. The first male plug is electrically connected to the at least one female outlet such that power received by the first male plug is transmitted to the at least one female outlet. The adapter-converter further includes a second body having a universal female outlet defining the first outlet configuration and a second male plug defining a second plug configuration. The second male plug is configured and dimensioned for reception in the at least one female outlet of the main body and the female outlet of the second body is configured and dimensioned to receive the first male plug of the main body. The adapter-converter further includes a third body having a universal female outlet defining a second outlet configuration and a third male plug defining a third plug configuration. The third male plug is configured and dimensioned for reception in the at least one female outlet of the main body and the female outlet of the third body is configured and dimensioned to receive the first male plug of the main body.

The main body may further include at least one universal female outlet defining a second outlet configuration where the second outlet configuration may be configured and dimensioned to receive the third male plug of the third body.

In the alternative, an adapter-converter for use with an electrical outlet includes a main body including a top, a bottom, a first side and a second side. The main body includes a first universal female outlet defining a first outlet configuration disposed on the top of the main body, a second universal female outlet defining a second outlet configuration disposed on the first side of the main body, and a third universal female outlet defining a third outlet configuration disposed on the second side of the main body. The bottom of the main body includes a first male plug defining a first plug configuration disposed thereon and electrically connected to the first, second, and third female outlets such that power received by the first male plug is transmitted to the first, second, and third female outlets. The first and second outlet configurations may be substantially the same. The main body may include a high power TRIAC power converter circuit electrically associated with the first female outlet of the main body. The first outlet configuration may be different than the second and third outlet configurations.

Any of the above aspects or alternatives of the present disclosure described may be combined with any other aspect or alternative of the present disclosure without departing from the scope of the present disclosure.

BRIEF DESCRIPTION OF DRAWINGS

The accompanying drawings, which are incorporated in and constitute a part of this specification, illustrate embodiments of the disclosure and, together with a general description of the disclosure given above and the detailed description of the embodiments given below, serve to explain the principles of the disclosure, wherein.

DETAILED DESCRIPTION OF EMBODIMENTS

Embodiments of the presently disclosed adapter-converter will now be described in detail with reference to the drawings wherein like numerals designate identical or corresponding elements in each of the several views.

Figure 1:
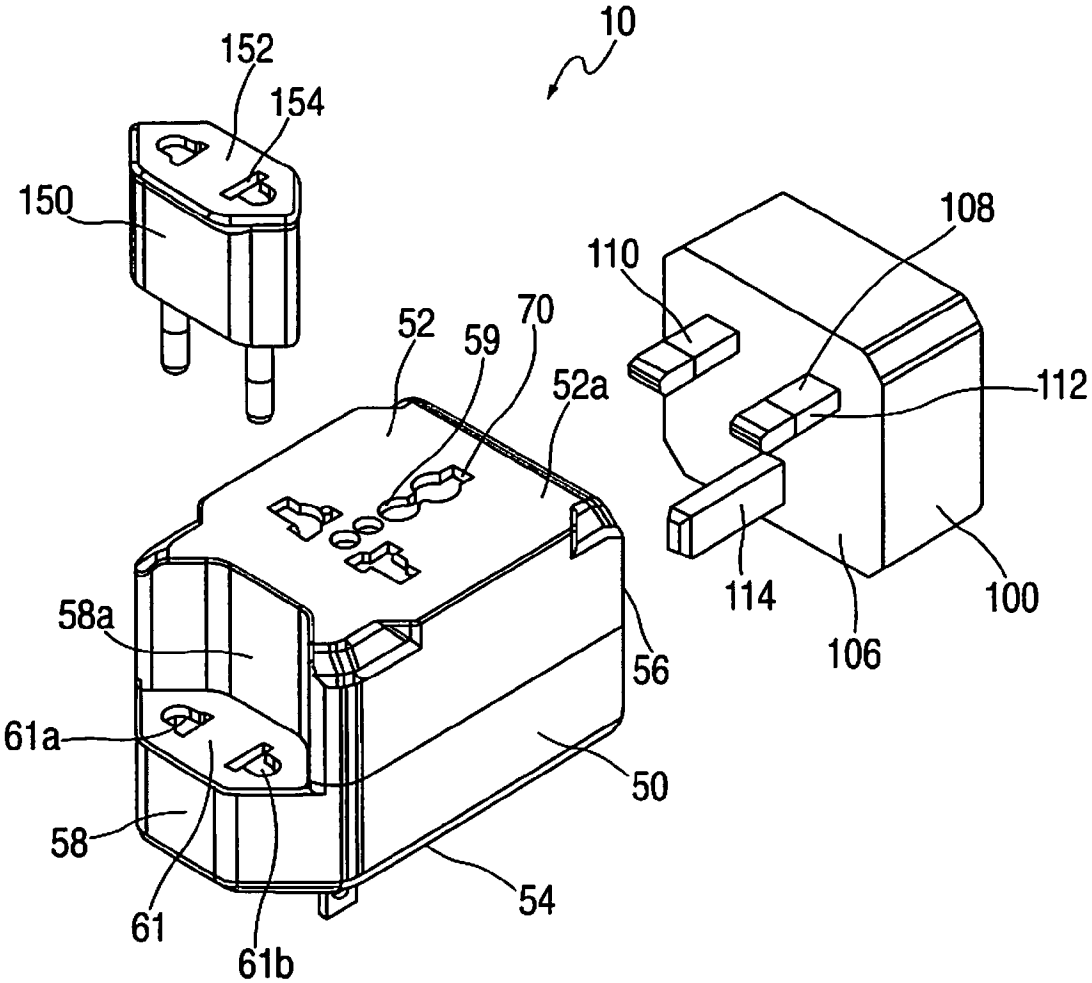
FIG. 1 is a disassembled perspective view of an adapter-converter assembly in accordance with an embodiment of the present disclosure.
Figure 2A:
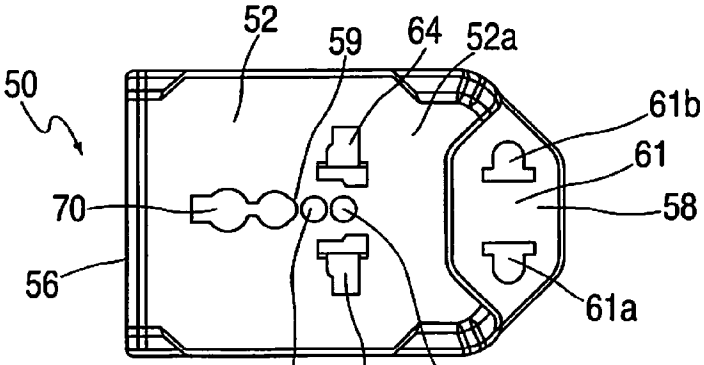
FIGS. 2A-2D are top and side plan views of a main body of the adapter-converter of FIG. 1.
Figure 2B:
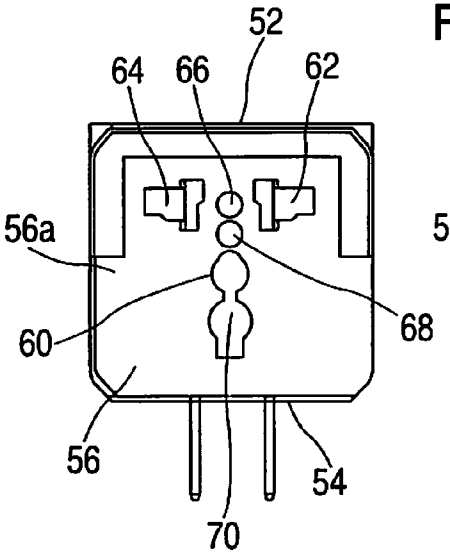
Figure 2C:
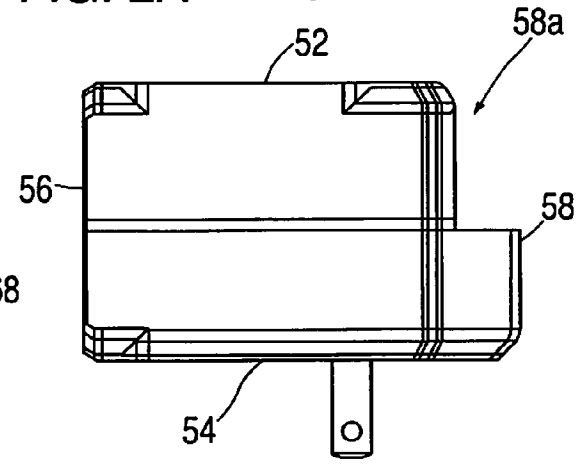
Figure 2D:
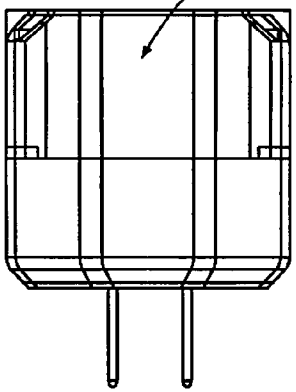

Referring initially to FIG. 1, an adapter-converter assembly is disclosed and is generally designated as adapter-converter assembly 10. Adapter-converter assembly 10 includes a main body 50, a second body 100 and a third body 150.

Referring now to FIGS. 1 and 2A-2D, main body 50 defines a substantially rectangular shape having a top 52, a bottom 54, a first side 56 and a second side 58. Each of the top and first side 52, 56 of main body 50 includes a universal female outlet 59, 60, respectively, configured for the reception of a variety of male plugs having different configurations or standards. Female outlets 59 and 60 define a first outlet configuration including first and second side openings 62, 64, first and second holes 66, 68, and a key-shaped opening 70.

The first and second side openings 62, 64 are dimensioned to receive a variety of different male plug prong configurations including, for example, round prongs such as those typically used in Europe, flat prongs such as those typically used in the United States and Japan, angled flat prongs such as those typically used in Australia, and linearly extending flat prongs such as those typically used in the United Kingdom, and other prongs used in various parts of the world. First and second holes 66 and 68 are dimensioned to receive a grounding pin from various male plugs including those found in, for example, Italy and Switzerland. Key-shaped opening 70 is dimensioned to receive grounding pins from various male plugs including those found in, for example, the U.S., Japan, Denmark, Australia, the U.K., and India.

Second side 58 of main body 50 includes a recess 58*a* (FIG. 1) configured for reception of third body 150 therein. Recess 58*a* includes a universal female outlet 61 defining a second outlet configuration including a pair of openings 61*a*, 61*b* that are configured for receiving plugs having two prongs such as those found in, for example, the U.S., Europe and Japan.

Figure 3B:
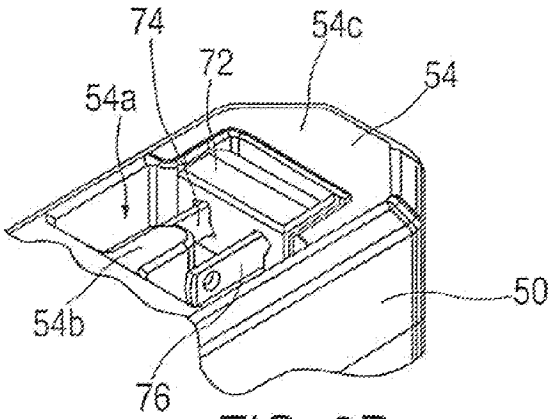
FIG. 3B is a partial perspective view of the main body of the adapter-converter assembly of FIG. 3A, illustrating the male plug of the main body rotated so the prongs are disposed in the recess of the main body.
Figure 3C:
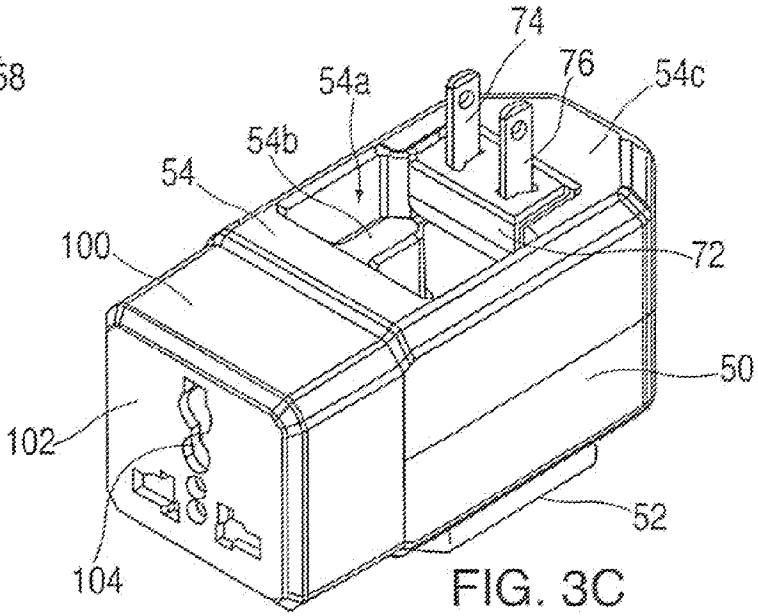
FIG. 3C is a perspective view of the main body of the adapter-converter assembly of FIG. 3A, illustrating the male plug of the main body rotated so the prongs extend from the main body.
Figure 3A:
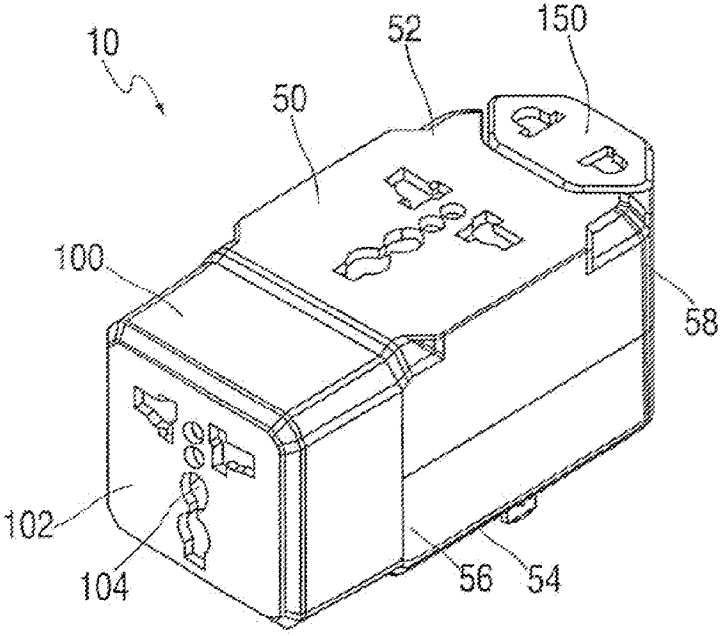
FIG. 3A is a perspective view of the adapter-converter assembly of FIG. 1, illustrating the first and second bodies assembled with the main body in the first configuration.

Referring now to FIGS. 3A-3C, bottom 54 of main body 50 includes a recess 54*a* having a male plug 72 rotatably mounted therein. Male plug 72 defines a first plug configuration including a pair of prongs 74, 76 configured and dimensioned for insertion into outlets typically used in the U.S., Japan, or Australia. Male plug 72 is rotatable from a first position (FIG. 3B), where male plug 72 is fully disposed within recess 54*a* with prongs 74, 76 disposed on either side of a flange 54*b* of bottom 54, to a second position (FIG. 3C), where male plug is rotated such that prongs 74, 76 extend away from a surface 54*c* of bottom 54. For example, male plug 72 may be rotated 90° from the first position to the second position such that prongs 74, 76 are disposed perpendicular to surface 54*c* of bottom 54.

Figure 4A:
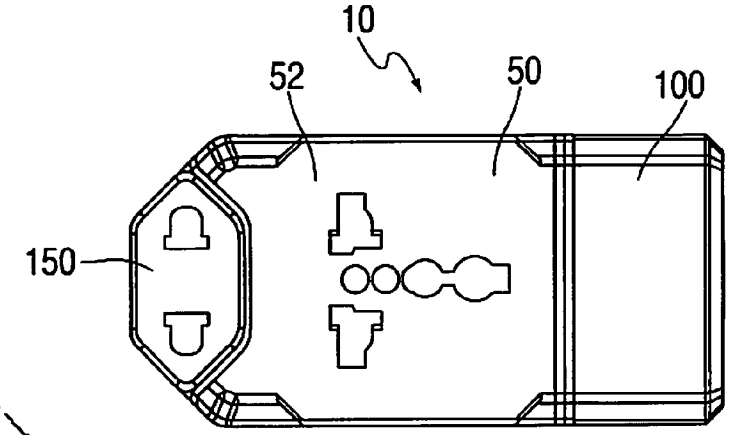
FIG. 4A is a top, plan view of the adapter-converter assembly of FIG. 3A.
Figure 4B:
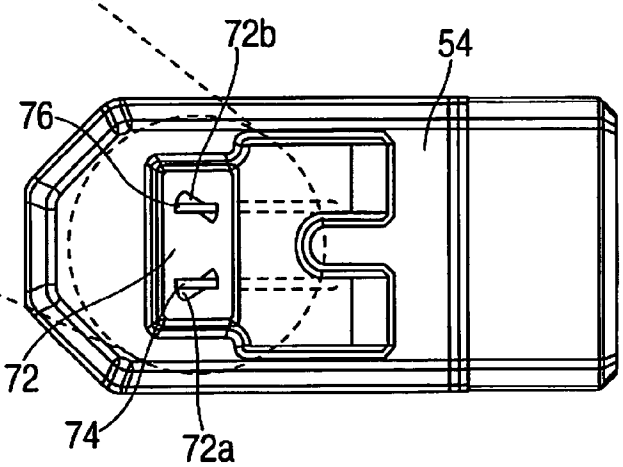
FIG. 4B is a bottom, plan view of the adapter-converter of FIG. 4A, illustrating the prongs of the male plug disposed in the first orientation.
Figure 4C:
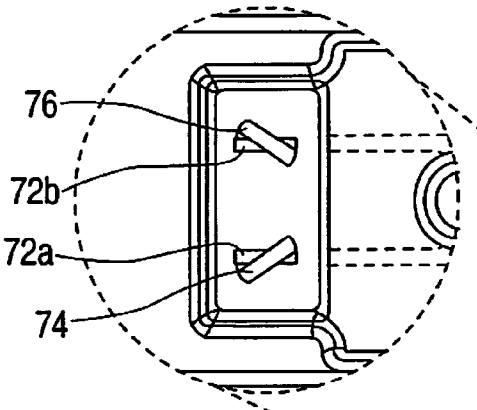
FIG. 4C is an enlarged isolated view of the area of detail depicted in FIG. 4B, illustrating the prongs of the male plug disposed in the second orientation.

Referring now to FIGS. 4B and 4C, prongs 74, 76 may be individually rotated relative to male plug 72 within slots 72*a* and 72*b* of male plug 72, respectively, between a first orientation (FIG. 4B), where prongs 74, 76 are substantially parallel to one another, and a second orientation, (FIG. 4C), where prongs are disposed at an angle to one another. Rotation of prongs 74, 76 to the second position allows prongs 74, 76 of male plug 72 to be inserted into outlets typically used in Australia, where the prong receiving slots (not shown) are correspondingly angled (e.g. not parallel) with respect to one another. Slots 72*a* and 72*b* of male plug 72 may be dimensioned so as to inhibit rotation of prongs 74, 76 to positions other than positions between the first and second positions, inclusive.

Referring now to FIGS. 1, 3A-3B, and 5A-5B, second body 100 includes a first side 102 having a universal female outlet 104 defining the first outlet configuration, similar to female outlets 59 and 60 of main body 50, and a second side 106 having a male plug 108 defining a second plug configuration including a pair of prongs 110, 112 and a ground pin 114. Prongs 110, 112 and ground pin 114 are configured and dimensioned for insertion into outlets typically used in the U.K. and each defines a generally rectangular cross-section and a tapered tip. It is contemplated that other configurations of prongs 110, 112 and ground pin 114 may be utilized to allow for compatibility with other countries.

Figure 6B:
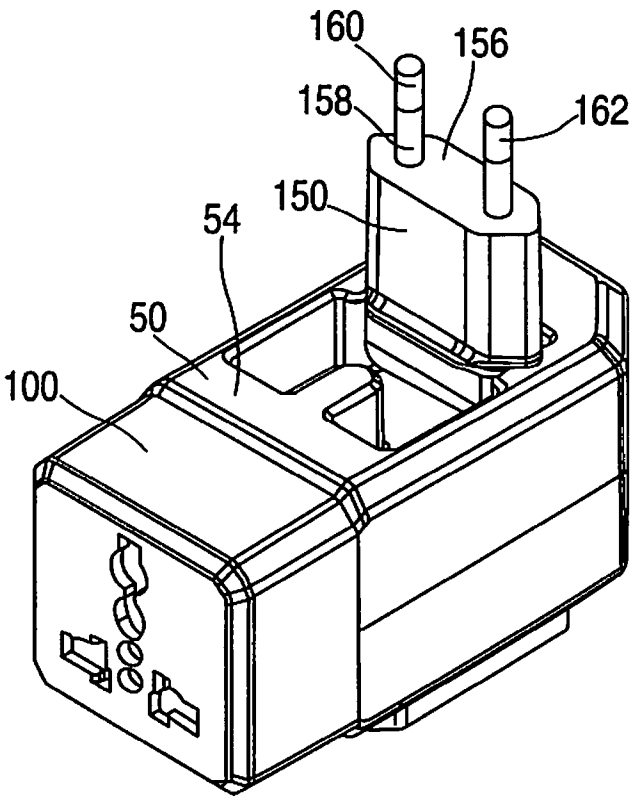
FIGS. 6A-6B are perspective views of the adapter-converter of FIG. 1, illustrating the adapter-converter in the fourth configuration.
Figure 6A:
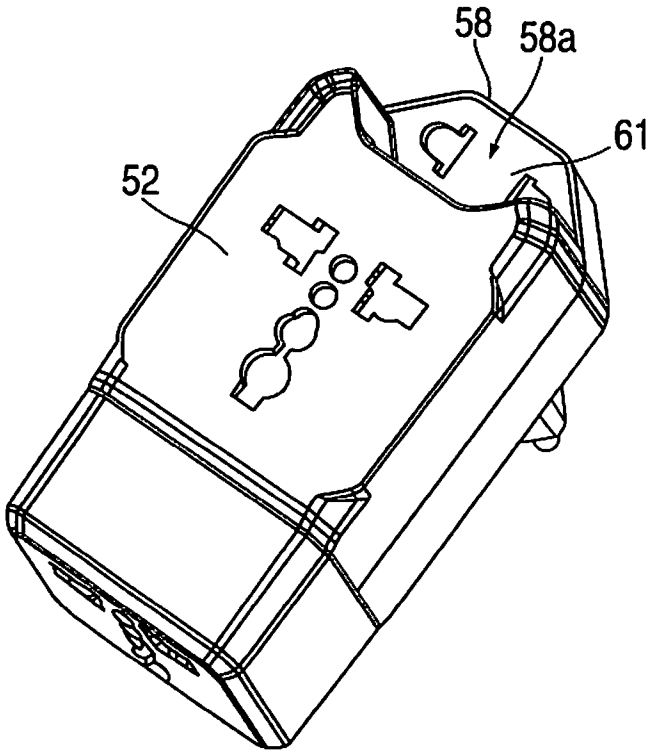
Figure 7B:
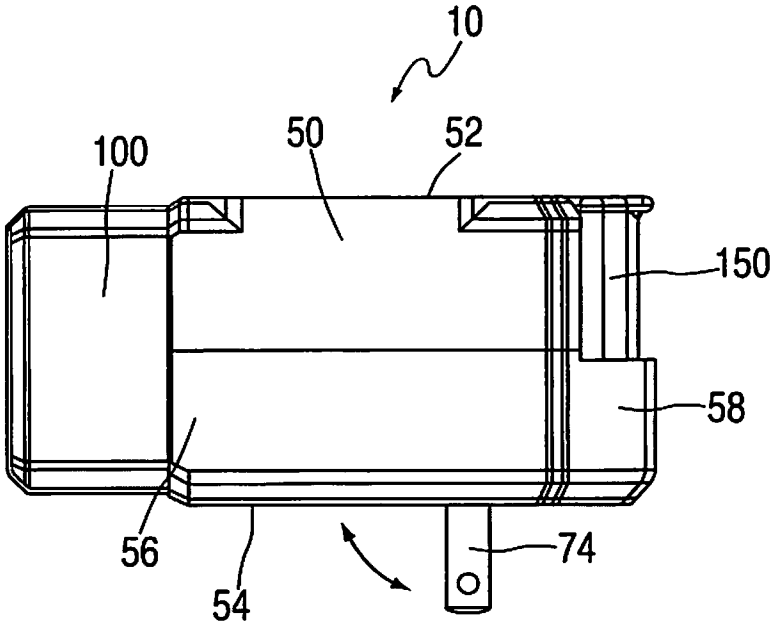
FIGS. 7A-7B are side, plan views of the adapter-converter of FIG. 3A.
Figure 7A:
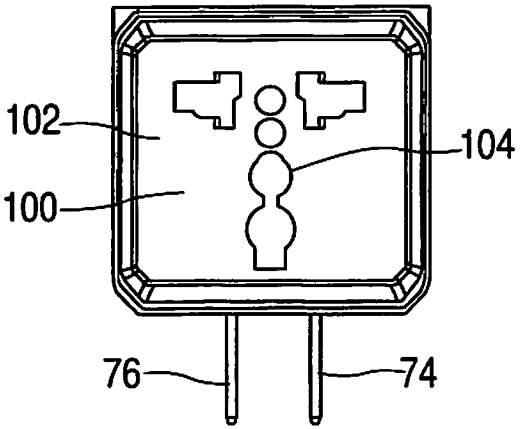

Referring now to FIGS. 1, 6A and 6B, third body 150 includes a first side 152 having a universal female outlet 154 defining the second outlet configuration, substantially similar to female outlet 61 of main body 50, and a second side 156 having a male plug 158 defining a third plug configuration including a pair of prongs 160, 162. Prongs 160, 162 are configured and dimensioned for insertion into outlets typically used in Europe and each defines a generally circular cross-section. It is contemplated that other arrangements of prongs 160, 162 may be utilized to allow for compatibility with other countries. Third body 150 defines a substantially hexagonal shape and is configured for insertion into recess 58*a* of main body 50 such that third body 150 defines a reduced profile relative to main body 50. For example, with third body 150 inserted into recess 58*a* of main body, main body defines a substantially rectangular shape.

Referring now to FIGS. 1, 3A-3C, and 7A-7B, in a first configuration, when adapter-converter assembly 10 is being used in the U.S., Japan, Australia, or other countries having a similar outlet configuration, male plug 72 is rotated to the second position such that prongs 74, 76 may be inserted into an electrical outlet. When the adapter-converter assembly 10 is being used in Australia, prongs 74, 76 are rotated from the first orientation to the second orientation. In the first configuration, second body 100 may be removably attached to first side 56 by inserting prongs 110, 112 and ground pin 114 into the female outlet 60 of the first side 56 of main body 50 to form an electrical connection between the female outlet 60 and the female outlet 104 of the first side 102 of second body 100. Third body 150 may be removably attached to second side 58 of main body 50 by inserting third body 150 into the recess 58*a* with prongs 160, 162 inserted into the female outlet 61 of second side 58 to form an electrical connection between the female outlet 61 of the second side 58 of main body 50 and the female outlet 154 of the first side 152 of third body 150. In this manner second body 100 and third body 150 may be efficiently and conveniently stored as part of adapter-converter assembly 10 without reducing the number of available female outlets for use by a user. For example, in the first configuration, three female outlets are available for use to accommodate variously configured electrical plugs.

Referring now to FIGS. 2A-2D, in a second configuration, similar to the first configuration, both second body 100 and third body 150 are detached from main body 50 such that female outlets 59, 60 and 61 are each exposed for use to accommodate variously configured electrical plugs.

Figure 5B:
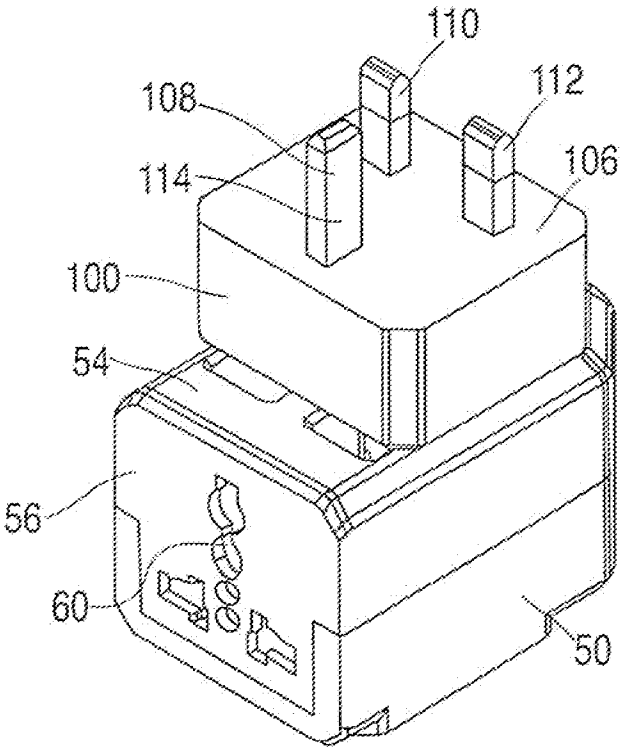
FIGS. 5A-5B are perspective views of the adapter-converter of FIG. 1, illustrating the adapter-converter in the third configuration.
Figure 5A:
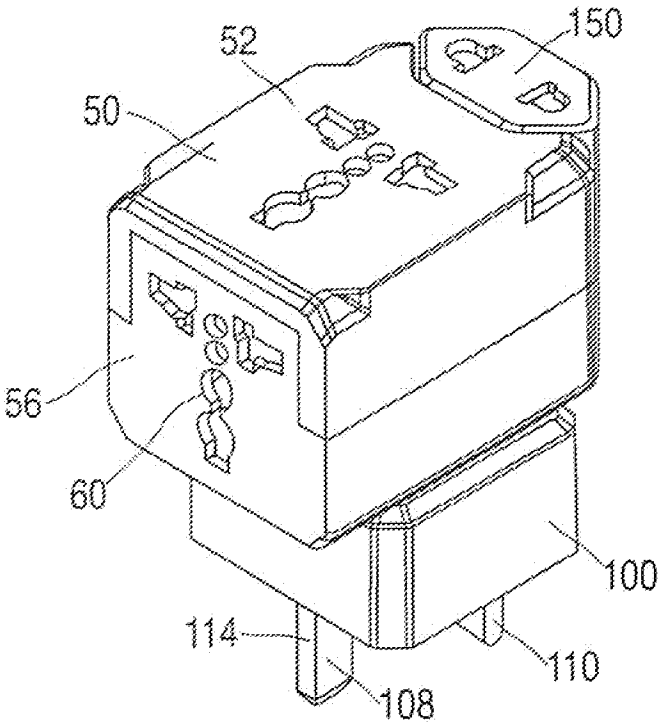

Referring now to FIGS. 5A and 5B, in a third configuration, when adapter-converter assembly 10 is being used in the U.K. or other countries having a similar electrical outlet configuration, second body 100 is removably attached to male plug 72 of bottom 54 of main body 50 by inserting the prongs 74, 76 of male plug 72 into the female outlet 104 of the second body 100 to electrically connect male plug 72 to male plug 108. In this manner, when male plug 108 is inserted into an electrical outlet such as those used in the U.K or other countries having a similar outlet configuration, power may be supplied from the electrical outlet through male plug 108 and second body 100, through male plug 72 and into main body 50 to be used by the female outlet 59 of the top 52 of main body 50, female outlet 60 first side 56 and the female outlet 61 of the second side 58 of main body 50. Third body 150 may be removably attached to main body 50 as described above for the first configuration. In this manner adapter-converter assembly 10 is configured for use with electrical outlets typically found in the U.K. while third body 150 is efficiently and conveniently stored as part of adapter-converter assembly 10 without reducing the number of available female outlets for use by a user. For example, in the third configuration, three female outlets are available for use to accommodate variously configured electrical plugs.

Referring now to FIGS. 6A and 6B, in a fourth configuration, when adapter-converter assembly 10 is being used in Europe or other countries having a similar electrical outlet configuration, third body 150 is removably attached to male plug 72 of main body 50 by inserting the prongs 74, 76 of male plug 72 into the female outlet 154 of the third body 150 to electrically connect male plug 72 to male plug 158. In this manner, when male plug 158 is inserted into an electrical outlet such as those used in Europe or other countries having similar outlet configurations, power may be supplied from the outlet through male plug 158 and third body 150, through male plug 72 and into main body 50 to be used by the female outlet 59 of the top 52 of main body 50, female outlet 60 of the first side 56 of main body 50 and the female outlet 61 of the second side 58 of main body 50. Second body 100 may be removably attached to main body 50 as described above for the first configuration. In this manner adapter-converter assembly 10 is configured for use with electrical outlets typically found in the Europe while second body 100 is efficiently and conveniently stored as part of adapter-converter assembly 10 without reducing the number of available female outlets for use by a user. For example, in the fourth configuration, three female outlets are available for use to accommodate variously configured electrical plugs.

Figure 8B:
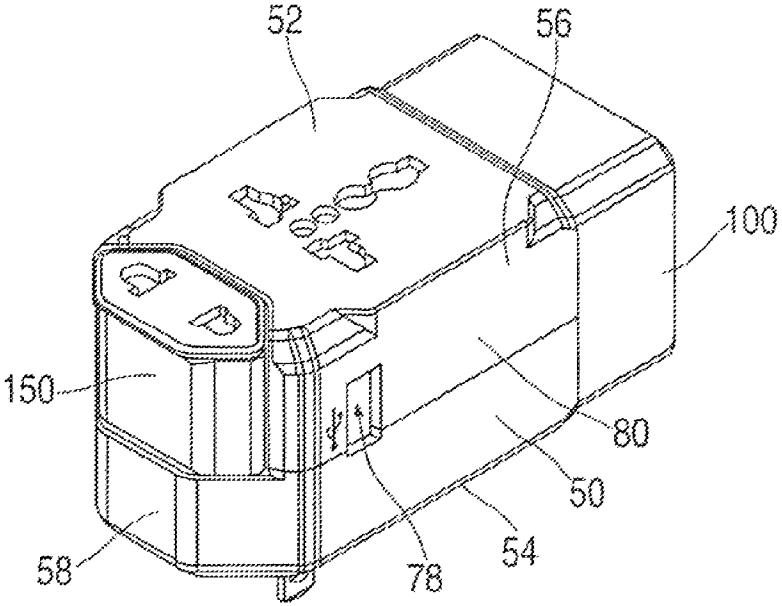
FIG. 8B is a perspective view of the adapter-converter of FIG. 8A.
Figure 8A:
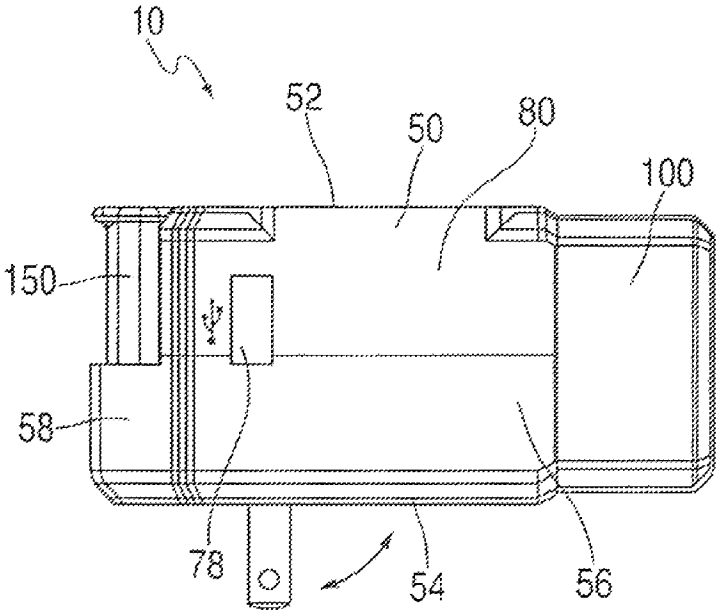
FIG. 8A is a side, plan view of an adapter-converter according to another embodiment of the present disclosure including a USB port.

Referring now to FIGS. 8A and 8B, main body 50 may include at least one Universal Serial Bus (USB) port 78 configured to receive at least one compatible USB plug-in device (not shown). USB port 78 may be disposed on a side surface 80 of main body 50 such that USB port 78 is accessible when female outlets 59, 60 and 61 are in use. USB port 78 is disposed in electrical communication with male plug 72.

Figure 9B:
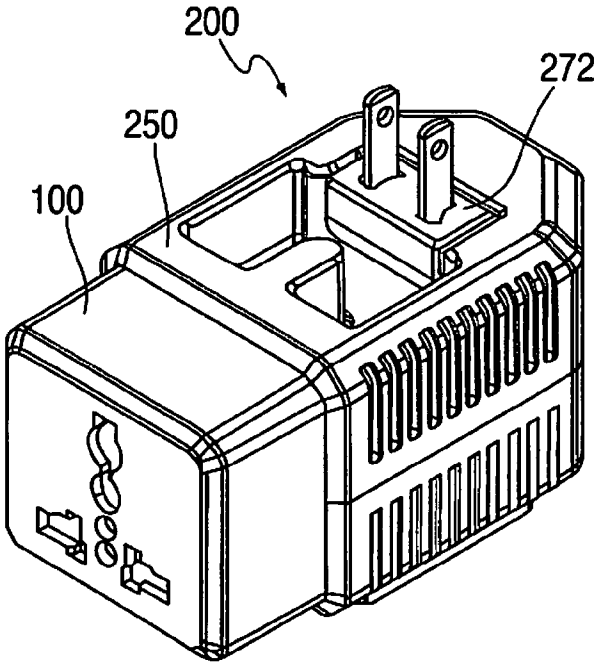
FIGS. 9A-9B are perspective views of an adapter-converter according to another embodiment of the present disclosure.
Figure 9A:
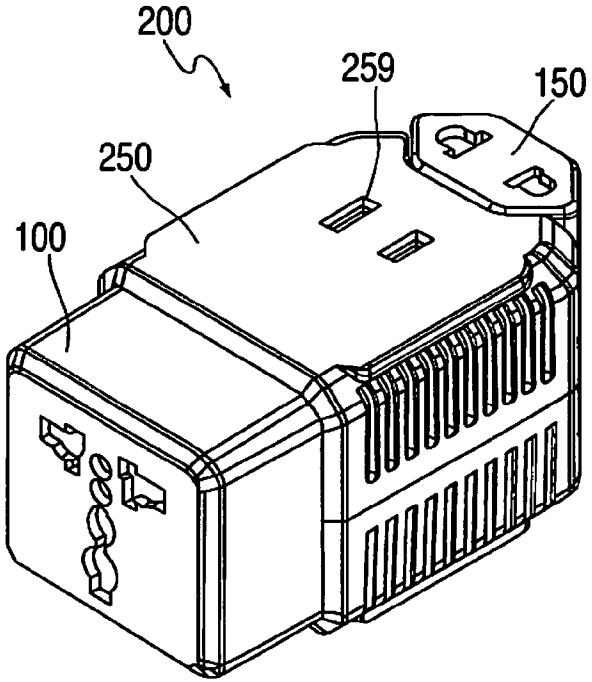

Referring now to FIGS. 9A and 9B, an adapter-converter 200 is disclosed which is similar to adapter-converter assembly 10. For brevity, elements found in both adapter-converter 200 and adapter-converter 10 are only shown where necessary. Adapter-converter 200 includes a main body 250, second body 100, third body 150 and male plug 272 defining the first plug configuration. Male plug 272 functions in a similar manner to male plug 72 of main body 50. Main body 250 replaces the universal female outlet 59 of main body 50 defining the first outlet configuration with a standard two slot female outlet 259 defining a third outlet configuration typically found in the U.S. Main body 250 also includes a first universal female outlet (not shown) defining the first outlet configuration, and a second universal female outlet (not shown) defining the second outlet configuration, similar to female outlets 60 and 61, respectively. Main body 250 is configured to receive second body 100 and third body 150 as described above with respect to adapter-converter assembly 10. Main body 250 includes a high power TRIAC power converter circuit 510 (FIG. 11) configured to convert from 240 volts AC input from male plug 272 to a 120 volts AC output. The high power TRIAC power converter circuit is electrically associated with female outlet 259 to convert the power output at female outlet 259 to a 120 volts AC output.

Figure 10A:
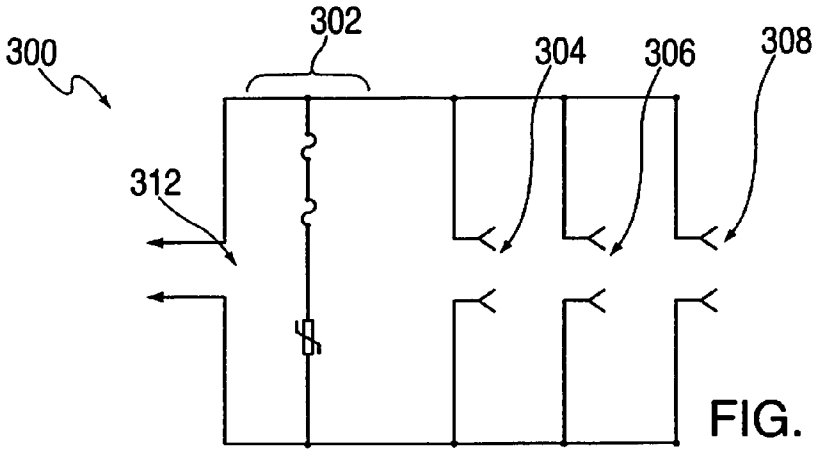
FIG. 10A is a circuit diagram in accordance with an embodiment of the present disclosure including a surge protection circuit.

Referring now to FIG. 10A, a circuit diagram 300 for main body 50 is disclosed including a surge protection circuit 302 disposed in parallel with a first outlet 304, second outlet 306, third outlet 308, and male plug 312. Each of first, second and third outlets 304, 306 and 308 corresponds to one of female outlets 59, 60 and 61 and male plug 312 corresponds to male plug 72. For example, surge protection circuit 302 may include, in series, a fuse "F1", a thermal fuse "TF1" and a varistor "MOV1". It is contemplated that surge protection circuit 302 may also or alternatively include other electrical components and configurations known in the art to provide surge protection.

Figure 10B:
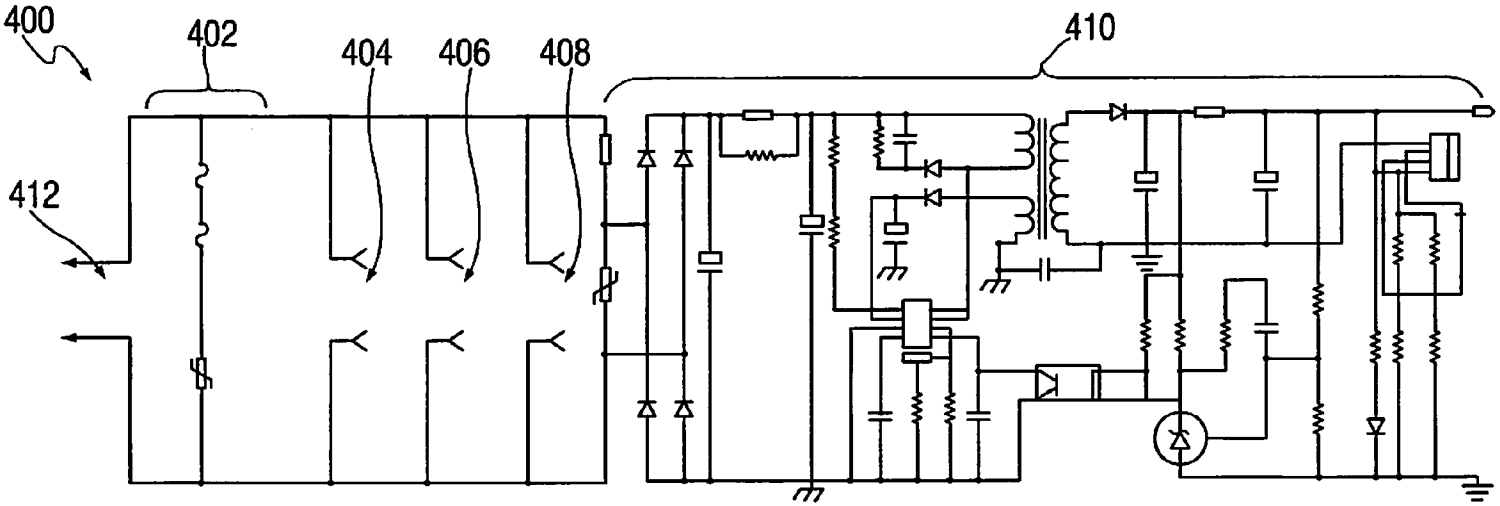
FIG. 10B is a circuit diagram in accordance with an embodiment of the present disclosure including a USB charging circuit.

With reference to FIG. 10B, a circuit diagram 400 for another embodiment of main body 50 is disclosed which is similar to circuit diagram 300 and includes a surge protection circuit 402 disposed in parallel with a first outlet 404, second outlet 406, third outlet 408 and a male plug 412. Each of first, second and third outlets 404, 406 and 408 corresponds to one of female outlets 59, 60 and 61 and male plug 412 corresponds to male plug 72. Circuit diagram 400 further includes a USB charging circuit 410 for providing power to USB port 78. It is contemplated that USB charging circuit 410 may also or alternatively include other electrical components and configurations known in the art to provide a power to a USB plug-in device.

Figure 11:
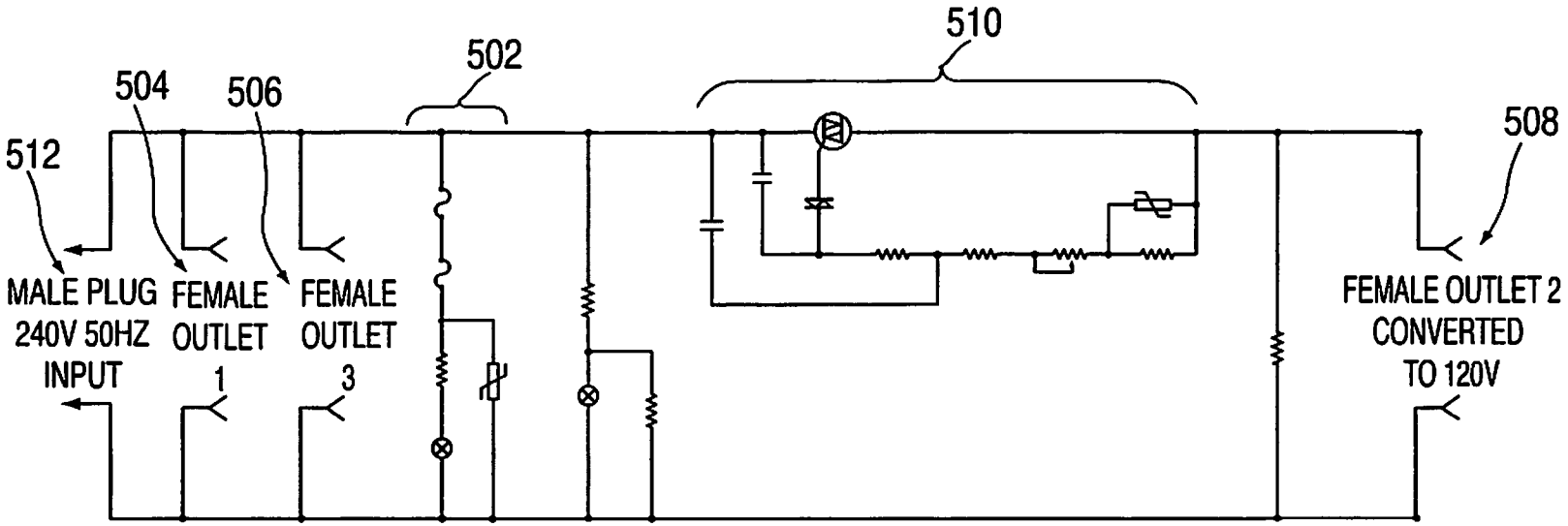
FIG. 11 is a circuit diagram in accordance with an embodiment of the present disclosure including a high power TRIAC power converter circuit.

With reference to FIG. 11, a circuit diagram 500 for main body 250 is disclosed including a surge protection circuit 502 disposed in parallel with a first outlet 504, a second outlet 506, a third outlet 508 and a male outlet 512. A high power TRIAC converter circuit 510 is disposed in series with third outlet 508 to convert a 240 volts AC input at male plug 272 to 120 volts AC at third outlet 508. First and second outlets 504, 506 correspond to first and second universal female outlets (not shown) of main body 250 and male outlet 512 corresponds to the male plug 272. Third outlet 508 corresponds to female outlet 529 of main body 250. For example, converter circuit 510 may include a triode alternating current (TRIAC) switch "Q1" having a diode for alternating current (DIAC) element "Q2" in series with a gate "G" of TRIAC switch "Q1" to regulate the triggering voltage of the TRIAC switch "Q1". A pair of capacitors "C1" and "C2" is disposed in parallel with TRIAC switch "Q1" and in series with resistors "R4" through "R7." Converter circuit 510 may also include a thermistor "PTC" in parallel with resistor "R7". Converter circuit 510 may also include a variable resistor, for example, resistor "R6". It is contemplated that converter circuit 510 may also or alternatively include other electrical components and configurations known in the art to convert an input of 240 volts AC to an output of 120 volts AC.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to the precise embodiments described herein, and that various other changes and modifications may be effected by one skilled in the art without departing from the scope or spirit of the present disclosure.

What is claimed is:

1. An adapter-converter assembly for use with an electrical outlet comprising:

a main body including a top, a bottom, a first side and a second side, the main body including a first universal female outlet defining a first outlet configuration disposed on the top of the main body, a second universal female outlet defining a second outlet configuration disposed on the first side of the main body and a third universal female outlet defining a third outlet configuration disposed on the second side of the main body, the bottom of the main body including a first male plug defining a first plug configuration disposed thereon, the first male plug being electrically connected to the first, second, and third female outlets such that power received by the first male plug is transmitted to the first, second, and third female outlets;

a second body having a fourth universal female outlet defining the second outlet configuration disposed on a first side and a second male plug defining a second plug configuration disposed on a second side, the second male plug being configured and dimensioned for reception in at least one of the first and second female outlets, the fourth female outlet being configured and dimensioned to receive the first male plug;

a third body having a fifth universal female outlet defining the third outlet configuration disposed on a first side and a third male plug defining a third plug configuration disposed on a second side, the third male plug being configured and dimensioned for reception in at least one of the first, second and third female outlets, the fifth female outlet being configured and dimensioned to receive the first male plug; and each of the first and second outlet configurations being dimensioned to receive multiple different male plug types.

2. The adapter-converter assembly according to claim 1, wherein the first and second outlet configurations are substantially the same.

3. The adapter-converter assembly according to claim 1, wherein in a first configuration, the second male plug of the second body is inserted into the second female outlet of the main body and the third male plug of the third body is inserted into the third female outlet of the main body.

4. The adapter-converter assembly according to claim 1, wherein in a second configuration, the first male plug of the main body is inserted into the fourth female outlet of the second body.

5. The adapter-converter assembly according to claim 4, wherein when in the second configuration, the third male plug of the third body is inserted into the third female outlet of the main body.

6. The adapter-converter assembly according to claim 1, wherein in a third configuration, the first male plug of the main body is inserted into the fifth female outlet of the third body.

7. The adapter-converter assembly according to claim 6, wherein when in the third configuration, the second male plug of the second body is inserted into the second female outlet of the main body.

8. The adapter-converter assembly according to claim 1, wherein the bottom of the main body includes a recess, the first male plug being rotatably disposed within the recess.

9. The adapter-converter assembly according to claim 1, wherein the first male plug includes a first prong and a second prong, the first and second prongs being rotatable relative to one another between a first orientation, where the first and second prongs are substantially parallel, and a second orientation, where the first and second prongs are at an angle to one another.

10. The adapter-converter assembly according to claim 1, wherein the main body includes a surge protection circuit.

11. An adapter-converter for use with an electrical outlet comprising:

a main body including a top, a bottom, a first side and a second side, the main body including a first universal female outlet defining a first outlet configuration disposed on the top of the main body, a second universal female outlet defining a second outlet configuration disposed on the first side of the main body, and a third universal female outlet defining a third outlet configuration disposed on the second side of the main body, the bottom of the main body including a first male plug defining a first plug configuration disposed thereon, the first male plug being electrically connected to the first, second, and third female outlets such that power received by the first male plug is transmitted to the first, second, and third female outlets, each of the first, second and third outlet configurations being dimensioned to receive multiple different male plug types.

12. The adapter-converter according to claim 11, wherein the first and second outlet configurations are substantially the same.

13. The adapter-converter assembly according to claim 2, wherein the third outlet configuration is different from the first and second outlet configurations.

14. The adapter-converter assembly according to claim 13 wherein the first and second outlet configurations each having multiple ground openings.

15. The adapter-converter assembly according to claim 12, wherein the third outlet configuration is different from the first and second outlet configurations.

16. The adapter-converter assembly according to claim 15 wherein the first and second outlet configurations each having multiple ground openings.

* * * * *